United States Patent [19]

Swartzbaugh

[11] 4,303,176

[45] Dec. 1, 1981

[54] UNITARY CONTAINER WITH IMPROVED LID ORIENTATION AND LOCKING MEANS

[75] Inventor: Peter T. Swartzbaugh, Toledo, Ohio

[73] Assignee: Owens-Illinois, Inc., Toledo, Ohio

[21] Appl. No.: 166,625

[22] Filed: Jul. 7, 1980

[51] Int. Cl.[3] ..... B65D 41/16; B65D 41/18

[52] U.S. Cl. ..... 220/306; 220/307

[58] Field of Search ..... 220/306, 307, 339, 337; 229/43

[56] References Cited

U.S. PATENT DOCUMENTS

| | | | |
|---|---|---|---|
| 4,040,518 | 8/1977 | Carter | 220/339 X |
| 4,105,136 | 8/1978 | May | 220/306 X |
| 4,231,474 | 11/1980 | Takahashi | 220/306 X |

*Primary Examiner*—George T. Hall

*Attorney, Agent, or Firm*—Thomas L. Farquer; Myron E. Click; David H. Wilson

[57] ABSTRACT

A container for storing various medical supplies such as bandages and gauze pads is provided which includes improved means for orienting the closure relative to the main body and locking the closure in place. The container includes a closure and a main body portion joined by a live hinge such that the closure engages the main body in a flush-like manner. The closure includes an improved rib and lug assembly which engages a complementarily-shaped slot in the main body front wall thereby orienting the closure relative to the main body and locking the closure in the closed position.

13 Claims, 9 Drawing Figures

UNITARY CONTAINER WITH IMPROVED LID ORIENTATION AND LOCKING MEANS

BACKGROUND OF THE INVENTION

1. Field of the Invention

The present invention relates to containers for medical supplies, such as, for example, gauze pads, bandages, surgical pads and the like. More particularly, the invention relates to an improved structural arrangement for orienting the hinged closure portion of the container relative to the main body portion and locking the closure into the preferred orientation with the main body in a closed position.

2. Description of the Prior Art

The container art is replete with diverse types of containers, or receptacles, for such items as gauze pads, bandages and the like. Typically, such containers are fabricated from plastic or metal and are of unitary or multiple piece construction.

Exemplary of the prior art is U.S. Pat. No. 2,492,864 which discloses a container, typically used for pills, which includes a bead and indentation pivot means in cooperation with a bead and indentation lid locking means. Similar structures are disclosed in U.S. Pat. Nos. 3,511,433; 3,966,083 and 4,102,452.

Another common type of lid locking means is the hook and slot type. This type locking means is exemplified by U.S. Pat. Nos. 2,605,926; 2,645,334; 3,285,464; 3,458,113; 3,811,563; 3,909,092 and 4,011,940. Each of the immediately above-described patents discloses a modification of the basic concept of the hook and slot locking means disclosed in the U.S. Pat. No. 2,605,926.

Nothwithstanding the existence of numerous types of containers suitable for storing medical bandages and the like, there is still a need in the art for providing a container which can be expediently and inexpensively manufactured yet which provides means not only to lock the closure in place but also to orient the closure with respect to the main body to provide a snug and well-aligned fit of the closure. There is especially a need in the art to minimize production costs in view of ever increasing prices of materials and labor. Accordingly, it is an object of the present invention to provide an inexpensive easily fabricated unitary container.

It is another object of the present invention to provide a container including means to orient the closure relative to the main body while simultaneously providing means to lock the closure onto the main body. Another object of the invention is to provide an orientation and locking means which restrains closure movement in both the vertical and horizontal direction relative to the main body of the container.

SUMMARY OF THE INVENTION

In accordance with the present invention, the inventor satisfies the above-described needs in the prior art by providing a unitary container which has structural features allowing the simultaneous orientation and locking of the closure relative to the main body of the container. Specifically, the invention typically includes a pair of locking ribs adjacent the front wall of the closure portion of the container. In the preferred embodiment, the locking ribs include a web portion adjacent the front wall of the closure terminating in a generally diamond-shaped locking lug. A generally frusto-conical rib is secured to the innermost surface of the web and lug assembly. A pair of complementarily-shaped slots are formed in the upper edge of the front main body wall in registry with the locking ribs. As the closure is pivoted frontally, the locking lug passes a tapered rib channel and locks into a generally diamond-shaped slot at the bottom of the rib channel, with the rib channel accepting the web portion of the locking rib. As the web and lug fill the slot, the frusto-conical rib is forced into engagement with the inner surface of the front wall of the main body.

The diamond-shaped locking lug locks the closure in the proper vertical orientation while the frusto-conical rib locks the closure in proper horizontal relationship to the main body front wall and prevents the main body front wall from flexing inwardly and thereby disengaging the locking lug from the slot.

BRIEF DESCRIPTION OF THE DRAWINGS

The above as well as other objects and advantages of the invention will become readily manifest to those skilled in the art from reading the following detailed description of an embodiment of the invention, when considered in light of the accompanying drawings in which.

DESCRIPTION OF THE PREFERRED EMBODIMENTS

Figure 1:
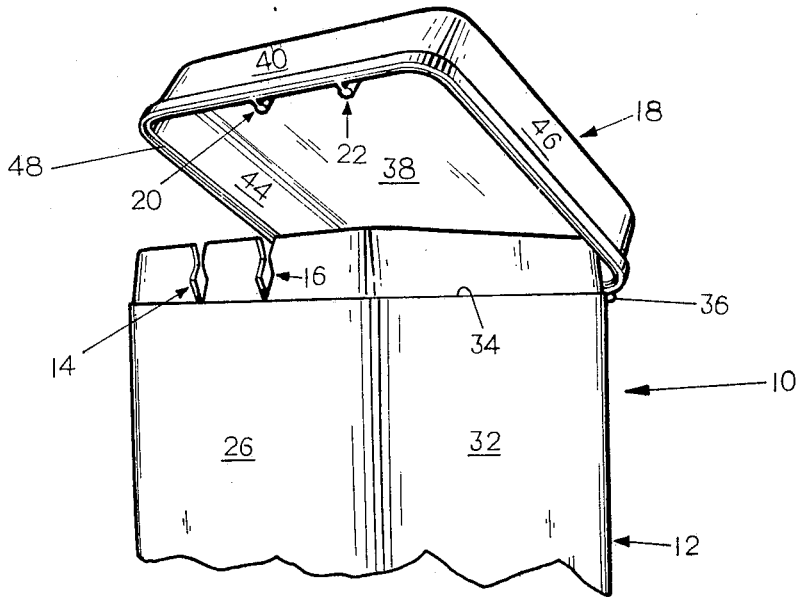
FIG. 1 is a perspective view showing the closure in the partially open position relative to the main body portion of the container and exemplifies various features of the present invention.
Figure 2:
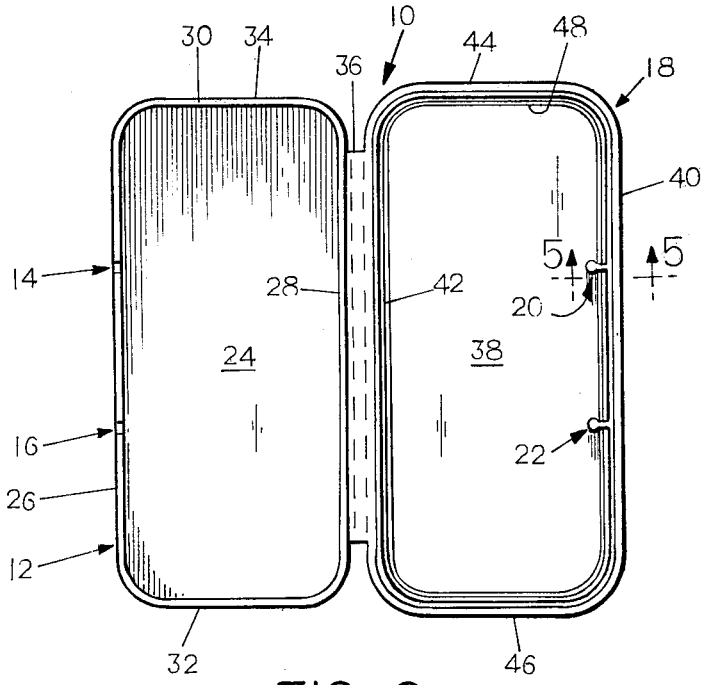
FIG. 2 is a top plan view with the lid of the container in open position illustrating the features of the present invention.

Referring to the drawings, and more particularly to FIGS. 1 and 2, there is illustrated a container 10 generally useful in storing gauze pads, medical bandages and dressings and the like. The container 10 is generally in the form of a rectangular, hollow main body portion 12 having at least a pair of slots 14 and 16 along the upper margin of the main body 12. A closure (lid) 18, being of generally rectangular shape and suited to be brought into closed relationship with the main body 12, includes a pair of locking ribs 20 and 22, respectively. The main body 12 and closure 18 can be of any suitable shape, such as circular, triangular or the rectangular shape illustrated in the preferred embodiment.

The main body 12 includes a bottom wall 24 and an upright perimeter wall comprised of front wall 26, rear wall 28 and pair of spaced apart opposed side walls 30 and 32, respectively. The uppermost portion of the main body 12 is tapered inwardly and provides a ledge 34 for engagement with the closure 18. The main body portion 12 is connected to the closure 18 by a so-called "live hinge" 36. Any suitable hinge wil suffice, but the use of a live hinge allows for the unitary construction preferred for the use of the invention.

The closure 18 includes a top wall 38 integral with a downwardly depending perimeter wall comprised of front wall 40, rear wall 42 and pair of spaced apart, opposed side walls 44 and 46, respectively. At the lower margin of the perimeter wall (40, 42, 44 and 46) is provided a rail 48 which engages the ledge 34 of the main body 12. Such engagement assists in maintaining the interior of the container 10 atmospherically distinct from the external environment. In an appropriate case, such as, for example, wherein the stored contents of the container 19 are environmentally sensitive, a gasket (not shown) may be included on the ledge 34 to facilitate atmospheric integrity of the internal space of the container 10.

Figure 3:
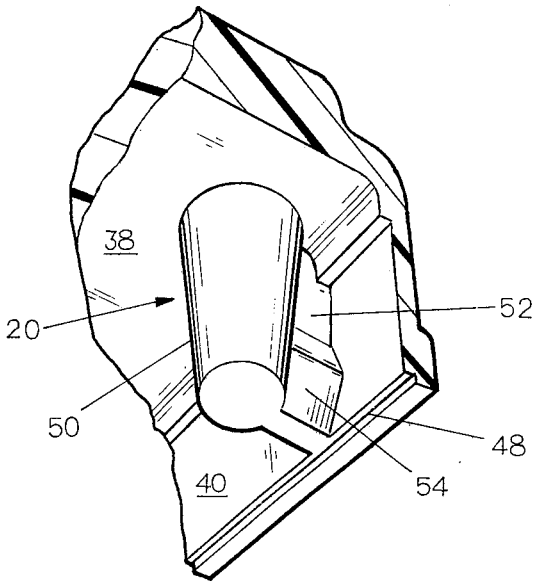
FIG. 3 is a fragmentary perspective view of the closure illustrating the locking rib of the present invention.
Figure 4:
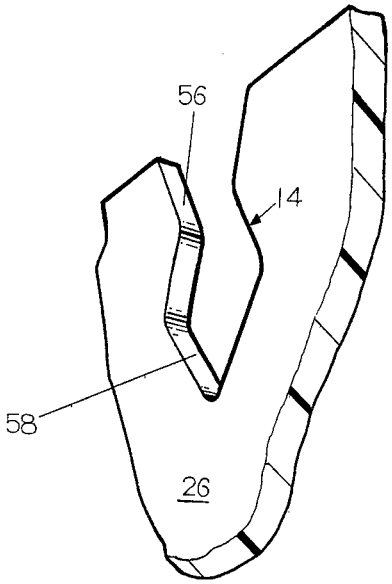
FIG. 4 is a fragmentary perspective view of the front wall portion of the container more clearly illustrating the slot in the wall.
Figure 6:
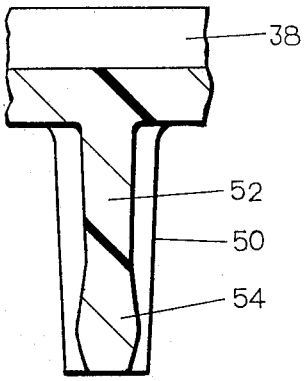
FIG. 6 is a sectional view taken along the line 6—6 on FIG. 5.
Figure 5:
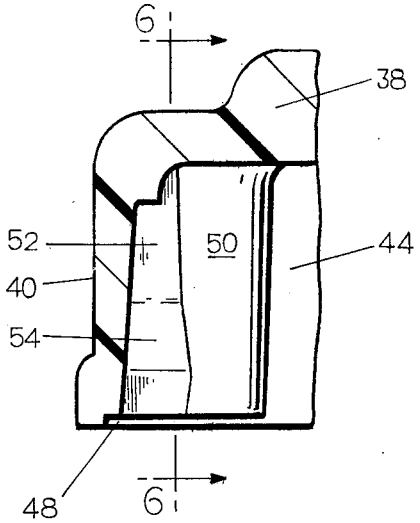
FIG. 5 is a fragmentary side elevational view taken along line 5—5 on FIG. 2 illustrating the locking rib of the present invention.
Figure 7:
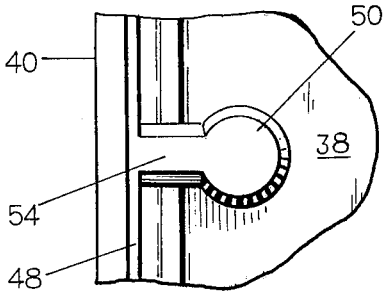
FIG. 7 is a bottom plan view of the locking rib of the present invention.
Figure 8:
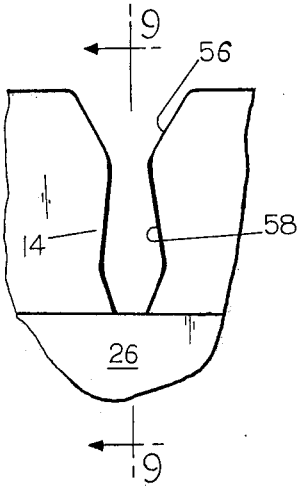
FIG. 8 is a fragmentary front view of the slotted front wall of the main body.
Figure 9:
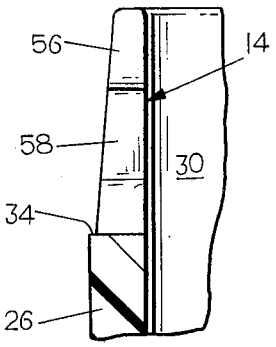
FIG. 9 is a sectional view taken along line 9—9 on FIG. 8.

The novel closure orienting and locking means of the present invention is generally illustrated in FIGS. 1 and 2 and specifically illustrated in FIGS. 3 and 4. The orienting and locking means of the present invention includes locking members on the closure having an outboard vertical motion restraining means and an inboard horizontal motion restraining means. In the preferred embodiment, the inboard horizontal motion restraining means is a frusto-conical rib 50 secured to and depending downwardly from the top wall 38 of the closure 18. The rib 50 is spaced apart from the front wall 40 by a web 52. The web 52 is secured to the rib 50, the front wall 40, the top wall 38 and terminates in a tapered, truncated, generally diamond-shaped locking lug 54. The locking lug 54 comprises the outboard vertical motion restraining means in the preferred embodiment. The locking lug 54 connects to both the rib 50, the web 52 and the front wall 40 and terminates slightly above the lower edge of the front wall 40, as does the rib 50, in a flat end surface. Both the rib 50 and the locking lug 54 terminate in flat surfaces for ease of mold fabrication and extraction.

The tapered, generally diamond-shaped geometry of the locking lug 54 facilitates the passage of the locking lug 54 through the web channel 56 and into the complementarily shaped lug slot 58 disposed along the front wall 26.

While in the preferred embodiment the locking lug 54 is a truncated diamond shape, it may be of any convenient geometry which may be engaged with a complementary lug slot 58 to limit the vertical motion of the closure 18 relative to the main body 12.

In the preferred embodiment, a generally frusto-conical rib 50 (see FIG. 3) is selected as the horizontal motion restraining means but any suitable shape may be used which has a greater transverse cross-sectional dimension than the transverse cross-sectional dimension of the locking lug 54. This is necessary so that the locking lug 54 may not be disengaged from the lug slot 58 by the inward motion of the front wall 26 past the locking lug 54 and the rib 50. Accordingly, any shape of rib 50 is acceptable so long as the transverse cross-sectional area is higher than the transverse cross-sectional area of the associated locking lug 54.

FIG. 4 best illustrates one of the slotted portions of the front wall 26 of the main body 12, such as, for example, the slot 14. The slot 14 includes an inwardly tapered web accepting channel 56, which channel 56 terminates in a generally diamond-shaped lug slot 58 which corresponds in shape to the shape of the locking lug 54.

FIGS. 5 through 9 illustrate various views of the cooperation locking lug 54 and the rib 50.

In operation, assume the hinged closure 18 is in the open position to allow for access to the interior space of the container 10. To close the container, the closure 18 is pivoted about the live hinge 36 into close engagement with the upper edge of the perimeter wall of main body 12; and to complete the closing operation, a slight downward pressure is imposed upon the closure 18 causing the locking lug 54 to penetrate the inwardly tapered web channel 56, pass through the web channel 56, flexing the channel outwardly thereby engaging locking lug 54 in lug slot 58. As the locking lug 54 penetrates web channel 56, the walls of web channel 56, due to the natural resiliency of the plastic, spring back to their original position thereby locking the locking lug 54 in the lower lug slot 58. The tapered walls of the generally diamond-shaped locking lug 54 complement and engage the tapered substantially diamond-shaped walls of the lug slot 58. The substantially diamond-shaped geometry assists in maintaining the locking lug 54 within the lug slot 58, thereby maintaining the closure in the proper orientation with and distance from the main body portion 12. This structural arrangement of lug 54 and slot 58 stabilizes the closure 18 within the main body 12, thereby preventing accidental vertical displacement of the closure 18 into an open position. Thus, an intentional upward pressure on the closure 18 must be exerted to disengage the locking lug 54 from the lug slot 58 to open the container 10. Random closure opening in the vertical plane is thereby militated against.

Another problem common in plastic containers is horizontal disengagement of locking lug 54 from lug slot 58 upon exerting inward pressure on the front wall 26 of the container 12. This pressure allows the springy live hinge to spontaneously open the container with little or no upward pressure. To militate against such accidental opening, the frusto-conical rib 50 is disposed immediately inboard of the web 52 and locking lug 54 assembly. Accordingly, inward pressure upon the front wall 26 of the main body 12 causes the front wall 26 to contact frusto-conical rib 50 prohibiting it from sliding past the web 52 and locking lug 54. Accidental opening by horizontal displacement of the web 52 and locking lug 54 is averted.

The containers according to the present invention can be expediently and economically manufactured from any suitable plastic, such as, for example, polyolefins, like polyethylene, polypropylene and the like, polystyrene, polyesters, polyamides or any other suitable polymeric material.

While the container has been described in its preferred embodiment as having utility for storing medical supplies such as gauze pads, bandages and the like, the container may equally well serve to contain medication, foodstuffs, and other commodities.

The invention not only provides for proper orientation and locking of the closure 18 relative to the main body 12, but also provides an aesthetically pleasing external appearance since the locking and orientation means are nowhere visible on the external surfaces of the container. This allows for a streamlined, smooth appearance in design complementing the novel features of the present invention.

While in the preferred embodiment the locking lug 54 and the complementarily shaped lug slot 58 are generally diamond-shaped, these complementary portions of the invention may be other suitable shapes. Similarly, the rib 50 being illustrated as frusto-conical with its broadened base attached to the closure top wall and its narrow portion adjacent the locking lug 54, the rib 50 may be of other suitable shapes to restrain the travel of the web 52 and locking lug 54, for example, rectangular, triangular, elliptical in cross section or any other suitable geometrical design. Clearly, the more simple the geometry, the less expensive the molding technology involved is. This is also applicable to the shape of the locking lug 54.

In accordance with the provisions of the patent statutes, I have explained the principle and mode of operation of the invention, and have illustrated and described in the preferred embodiment what is considered its best embodiment. It is understood that, within the scope of the appended claims, the invention may be practiced otherwise than specifically illustrated and described in the preferred embodiment and accompanying alternatives herein.

I claim:

1. A selectively openable and closable container molded as a unitary structure, said container comprising:

a shaped hollow main body member, said main body member having at least one vertical motion restraining member accepting portion disposed on the upper edge;

a matching shaped hollow closure member;

a hinge member integrally connecting said closure member with said main body member; and a locking member on said closure member including an outboard vertical motion restraining member of the same shape as said vertical restraining member accepting portion, in registry with said vertical restraining member accepting portion and further including an inboard horizontal motion restraining member adjacent said outboard vertical motion restraining member.

2. The invention defined in claim 1 wherein said outboard vertical motion restraining member includes a generally diamond-shaped locking lug.

3. The invention defined in claim 1 wherein said horizontal motion restraining means is a generally frusto-conical rib secured to the inboard surface of said vertical motion restraining means.

4. The invention defined in clam 1 wherein said container is fabricated of polyethylene.

5. The invention defined in claim 1 wherein said container is fabricated of polypropylene.

6. The invention defined in claim 1 wherein said container is fabricated of polystyrene.

7. The invention defined in claim 1 wherein the largest transverse cross-sectional measure of said horizontal motion restraining member is greater than the largest transverse cross-sectional measure of said vertical motion restraining member.

8. A selectively openable and closable container, said container comprising:

a main body including a bottom wall and upstanding perimeter wall and defining a three-dimensional compartment, said main body including a generally vertically disposed locking slot extending downwardly therein from the upper marginal edge of said perimeter wall and having a lower portion wider than its upper portion;

a matching closure pivotally secured to said perimeter wall of said main body remote from said locking slot therein; and a locking and orienting means on said closure and in registry with said locking slot, said locking means including a first member insertable into said locking slot and shaped to correspond with said locking slot, and a second member inboard of said first member and of a larger area than said first member, whereby said first member militates against vertical motion of said closure and said second member militates against horizontal motion of said closure.

9. The invention defined in claim 8 wherein said locking slot includes an upper and a lower portion wherein said upper portion is of substantially V-shaped configuration having its narrowmost portion terminating adjacent a substantially diamond-shaped lower portion.

10. The invention defined in claim 8 wherein said second member is a generally frusto-conical rib integral with and inboard of said first member.

11. The invention defined in claim 8 wherein said container is fabricated of polystyrene.

12. The invention defined in claim 8 wherein said container is fabricated of polyethylene.

13. The invention defined in claim 8 wherein said container is fabricated of polypropylene.

* * * * *

UNITED STATES PATENT AND TRADEMARK OFFICE

CERTIFICATE OF CORRECTION

PATENT NO. : 4,303,176

DATED : Dec. 1, 1981

INVENTOR(S) : Peter T. Swartzbaugh

It is certified that error appears in the above-identified patent and that said Letters Patent are hereby corrected as shown below:

Col. 3, line 16, "19" should be --10--.

Signed and Sealed this

*Sixteenth* Day of *March 1982*

[SEAL]

*Attest:*

GERALD J. MOSSINGHOFF

*Attesting Officer*

*Commissioner of Patents and Trademarks*